US009745939B1

(12) United States Patent
Rzepka

(10) Patent No.: US 9,745,939 B1
(45) Date of Patent: Aug. 29, 2017

(54) EQUIPMENT STABILIZER FOR A PULL CORD START

(71) Applicant: Gary Rzepka, South Bend, IN (US)

(72) Inventor: Gary Rzepka, South Bend, IN (US)

( * ) Notice: Subject to any disclaimer, the term of this patent is extended or adjusted under 35 U.S.C. 154(b) by 83 days.

(21) Appl. No.: 14/806,626

(22) Filed: Jul. 22, 2015

(51) Int. Cl.

| | |
|---|---|
| ***F02N 3/04*** | (2006.01) |
| ***F02N 3/02*** | (2006.01) |
| ***B27B 17/00*** | (2006.01) |
| ***F02N 3/00*** | (2006.01) |

(52) U.S. Cl.
CPC ..... *F02N 3/04* (2013.01); *B27B 17/00* (2013.01); *F02N 3/00* (2013.01); *F02N 3/02* (2013.01)

(58) Field of Classification Search
CPC ..... F02N 3/00; F02N 3/02; F02N 3/04
USPC ..... 123/185.1, 185.2, 185.3, 185.5, 185.6
See application file for complete search history.

(56) References Cited

U.S. PATENT DOCUMENTS 3,018,768 A * 1/1962 Thompson ..... F02N 3/04 123/185.2
3,040,726 A * 6/1962 Mayer ..... F02N 3/04 123/185.5
3,626,937 A * 12/1971 Gjovik ..... F02N 3/04 123/185.2
4,109,538 A * 8/1978 Glenday ..... F02N 3/02 123/185.2
4,257,367 A * 3/1981 Fujikawa ..... F02N 3/02 123/182.1
4,397,274 A * 8/1983 Tarnedde ..... A01D 34/6818 123/185.2
5,070,828 A * 12/1991 Chestnutt ..... F02N 3/04 123/185.4
5,133,312 A * 7/1992 Schede ..... F02N 3/02 123/185.2
5,174,166 A * 12/1992 Tryon ..... F02N 3/02 74/140
5,253,540 A * 10/1993 Sanders ..... F02N 3/02 123/185.4
5,762,037 A * 6/1998 Rothrock ..... F02N 3/04 123/185.4
6,321,709 B1 * 11/2001 Lyon ..... A01D 34/6818 123/185.4
6,497,210 B1 * 12/2002 Kattenhorn ..... F02N 3/02 123/185.4
7,322,334 B1 * 1/2008 O'Brien ..... B27B 17/00 123/185.4
7,478,617 B2 * 1/2009 Wang ..... F02N 3/02 123/185.4
8,539,925 B2 * 9/2013 Gleason ..... F02N 7/02 123/185.2

(Continued)

*Primary Examiner* — Erick Solis
(74) *Attorney, Agent, or Firm* — Stevenson IP, LLC

(57) ABSTRACT

An equipment stabilizer for a pull cord start that secures a piece of equipment, such as a chain saw, to a base plate via lockable jig clamps and assists in pulling the pull cord start by providing a pulley operated by a foot pedal. Ratchet straps pass through a horizontal slot through the base plate. An upright beam on the base plate front side has vertically aligned apertures proximal an upper side thereof for spring tension adjustment. A pulley operationally connects a pedal member of the foot pedal to a handle of the pull cord start. Pressing on the pedal member while holding onto the vertical beam moves the pull cord start handle toward the wheel end to start a motor of the piece of equipment.

2 Claims, 5 Drawing Sheets

(56) References Cited

U.S. PATENT DOCUMENTS

| | | | | |
|---|---|---|---|---|
| 2014/0000546 | A1* | 1/2014 | Hardy | F02N 3/02<br>123/185.4 |
| 2015/0136059 | A1* | 5/2015 | Mulligan | F02N 3/04<br>123/185.1 |

* cited by examiner

EQUIPMENT STABILIZER FOR A PULL CORD START

BACKGROUND OF THE INVENTION

Various types of devices to assist with starting a small engine with a pull cord are known in the prior art. However, what is needed is an equipment stabilizer for a pull cord start of a motor of a piece of equipment such as a chain saw, a weed eater, a leaf blower, a generator, and a log splitter.

FIELD OF THE INVENTION

The present invention relates to an equipment stabilizer for a pull cord start.

SUMMARY OF THE INVENTION

The general purpose of the present equipment stabilizer for a pull cord start, described subsequently in greater detail, is to provide an equipment stabilizer for a pull cord start which has many novel features that result in an equipment stabilizer for a pull cord start which is not anticipated, rendered obvious, suggested, or even implied by prior art, either alone or in combination thereof.

With reference now to the drawings, and in particular FIGS. 1 through 5 thereof, an example of the instant equipment stabilizer for a pull cord start employing the principles and concepts of the present equipment stabilizer for a pull cord start and generally designated by the reference number will be described.

To accomplish this, the present equipment stabilizer for a pull cord start is provided to assist in pulling a pull cord start for a piece of equipment such as a chain saw, a weed eater, a leaf blower, a generator, and a log splitter. The device includes a base plate and a jig clamp disposed on a top side of the base plate proximal each of front and rear sides of the base plate. Each lockable jig clamp to secure a handle portion and a front portion of the piece of equipment includes an inverted U-shaped brace having parallelepiped left and right ends with a parallelepiped cross-member disposed therebetween, and an opening between the left and right ends, the cross-member and the base plate top side. A pair of lockable jig bolts on each jig clamp is disposed atop the cross-member on each of the left and right ends. Each jig bolt has a locking knob therein to secure the respective brace onto the base plate. A horizontal slot is centrally disposed through the entire base plate from a right side to a left side of the base plate and continuously extends between the jig clamp on the front side to the jig clamp on the rear side. A pair of adjustable ratchet straps is extendible through the slot proximal each of the front side and the rear side to secure the piece of equipment to the base plate.

A hollow square tube upright beam is centrally disposed on the base plate front side and has a plurality of vertically aligned apertures is disposed through upright beam proximal an upper side thereof. A foot pedal is provided which includes a sleeve that slidingly engages the upright beam and a pedal member which has an upper surface, a lower surface, an outer surface, and an inner surface, which is disposed on a front surface of the sleeve. In addition, the foot pedal includes a plurality of ball bearings. A pair of the ball bearings is forward ball bearings disposed on the sleeve front surface in a position proximal the upper surface and the lower surface, respectively. One of the ball bearings is a rearward ball bearing disposed on the sleeve rear surface at a center thereof. A first eyebolt is disposed on the rear surface of the sleeve in alignment with the forward ball bearing disposed proximal the upper surface. A second eyebolt is selectively disposed in one of the apertures in the upright beam to adjust an amount of tension on a pull start cord of a piece of equipment. Each of the first and second eyebolts has an attachment arm and an eyelet. A spring is continuously disposed from the second eyebolt attachment arm to the first eyebolt attachment arm.

A pulley is provided to operationally connect the pedal member to the pull cord start. The pulley includes a cable, a wheel end mounted to the second eyebolt eyelet, a ring attached at a first end of the cable to the first eyebolt eyelet, and a carabiner attached to a second end of the cable. The carabiner is attachable to a handle of the pull cord start of the piece of equipment. The handle of the pull cord start moves toward the wheel end of the pulley upon the placement of pressure upon the pedal member upper surface. Movement of the pull cord start handle toward the wheel end activates a motor of the piece of equipment.

Thus has been broadly outlined the more important features of the present equipment stabilizer for a pull cord start so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
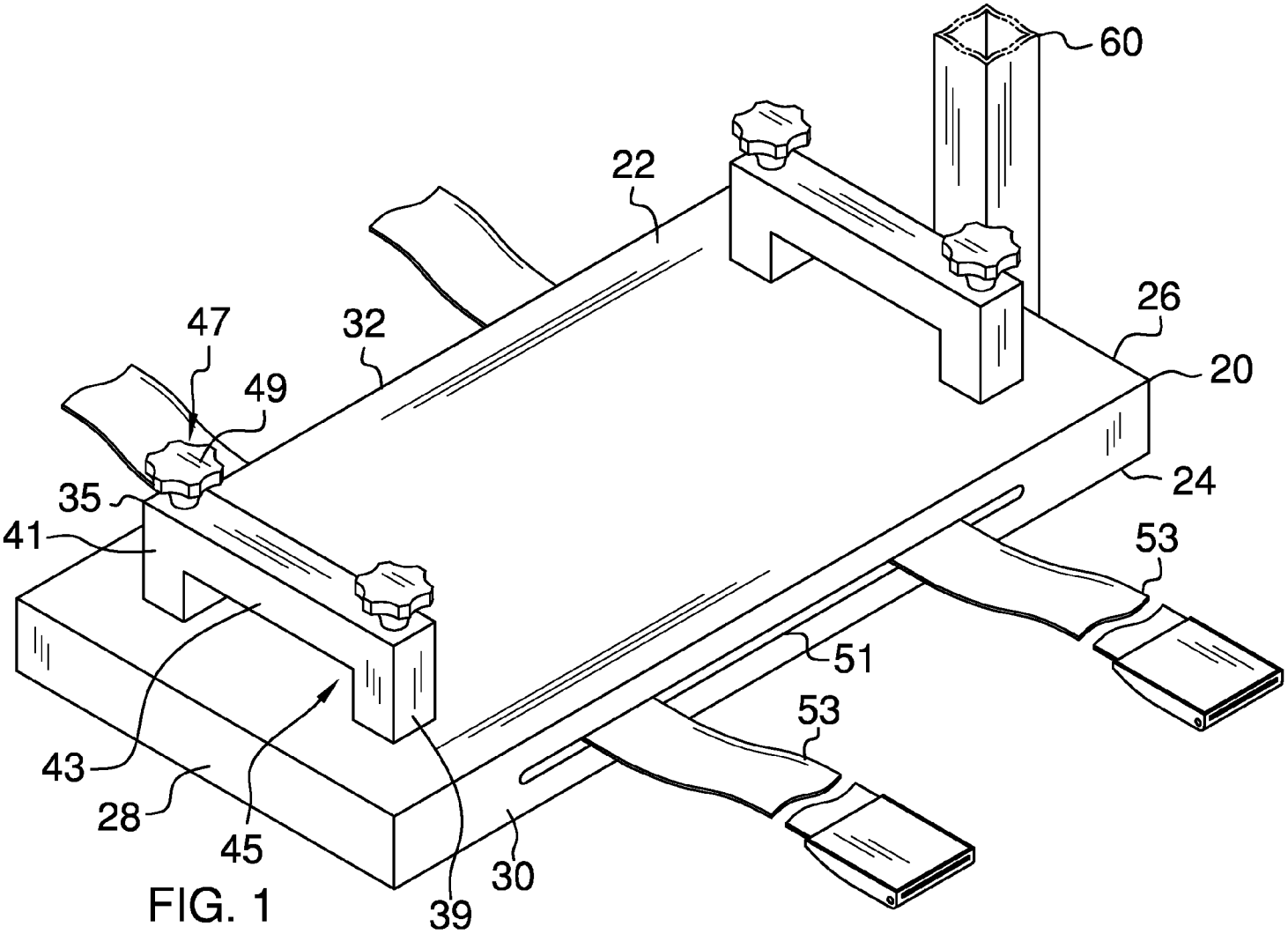
FIG. 1 is an isometric view of a base plate.
Figure 2:
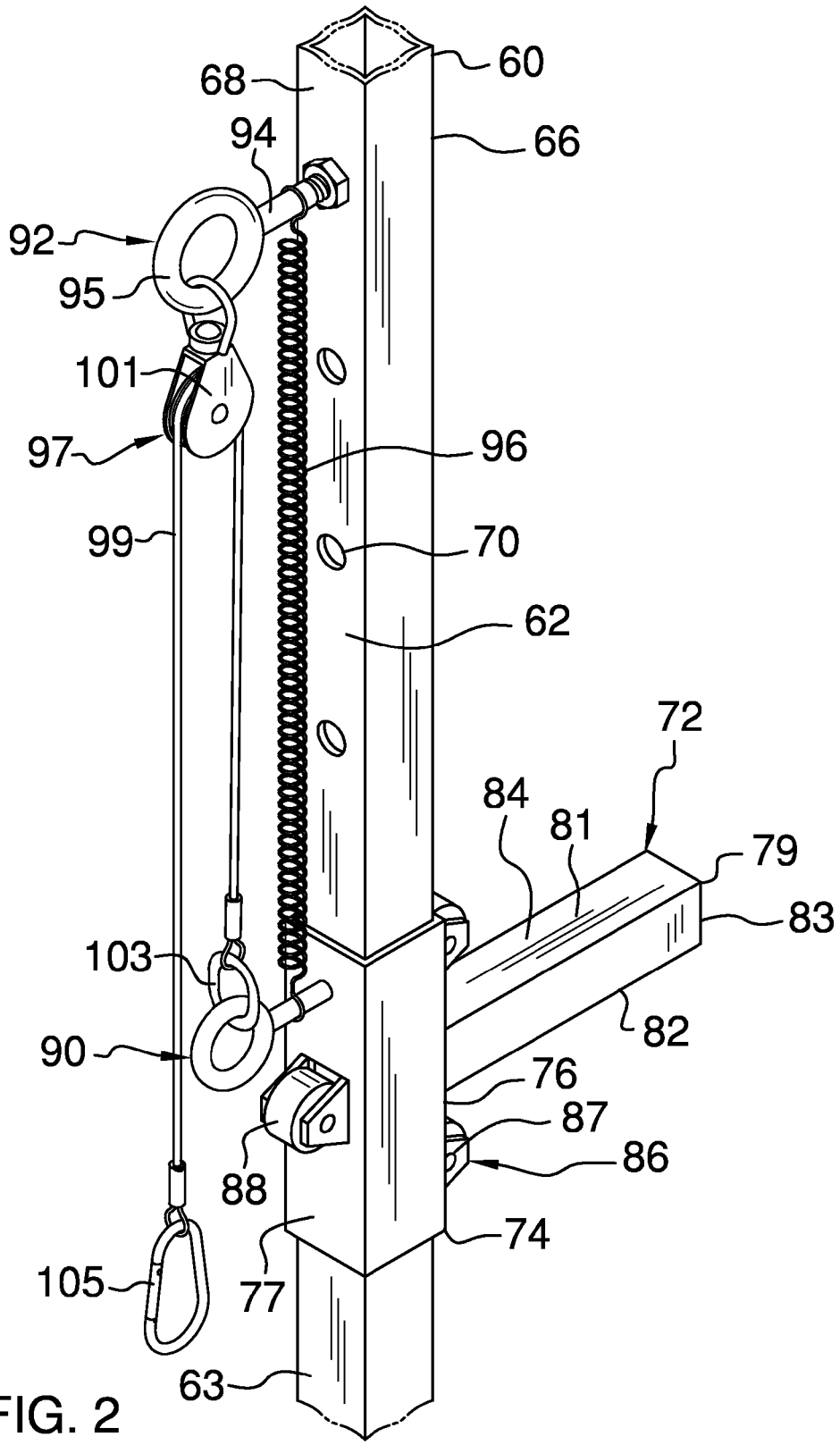
FIG. 2 is an isometric view of an upright beam.
Figure 3:
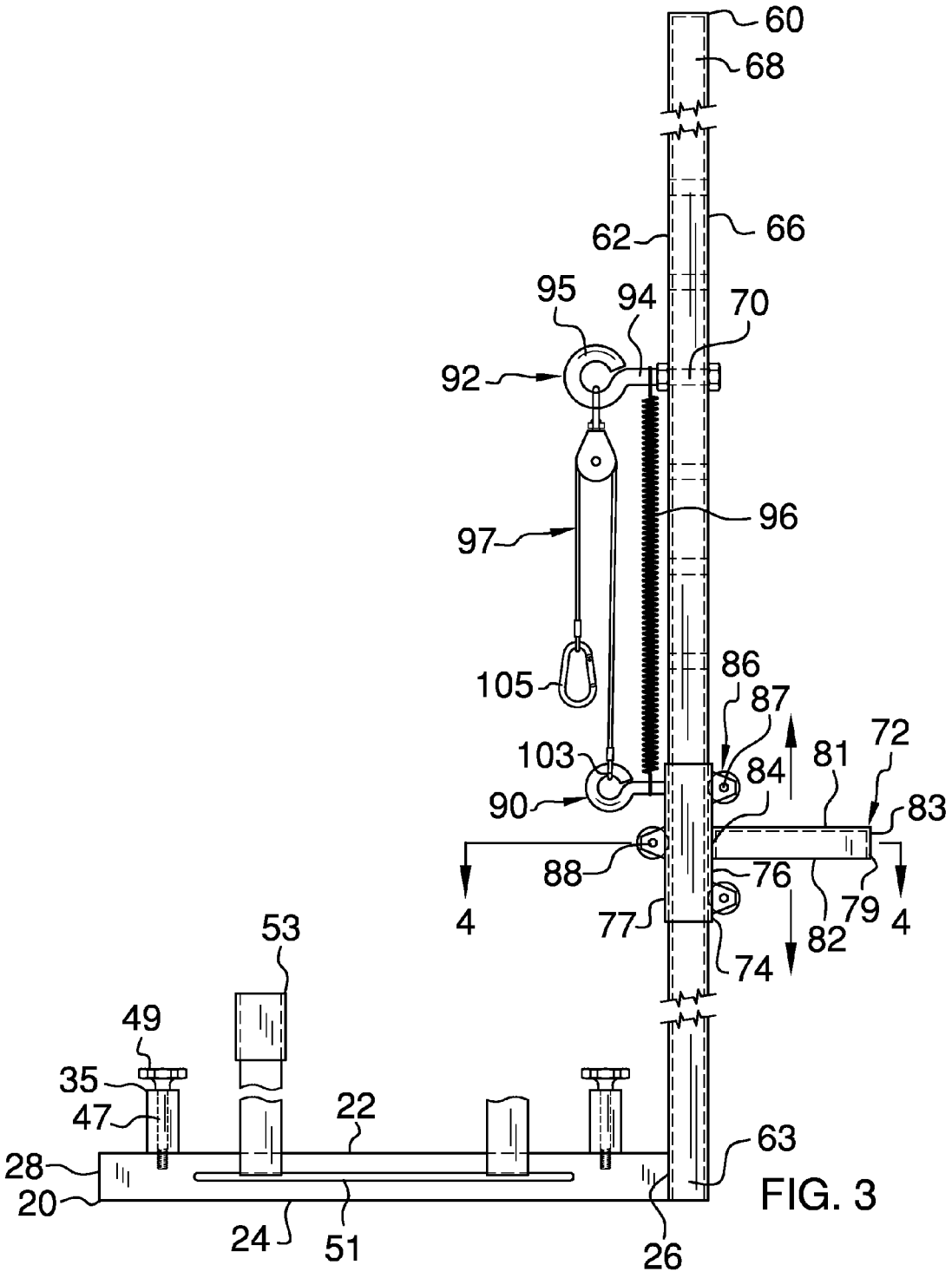
FIG. 3 is a side elevation view of the base plate and the upright beam assembled together.
Figure 4:
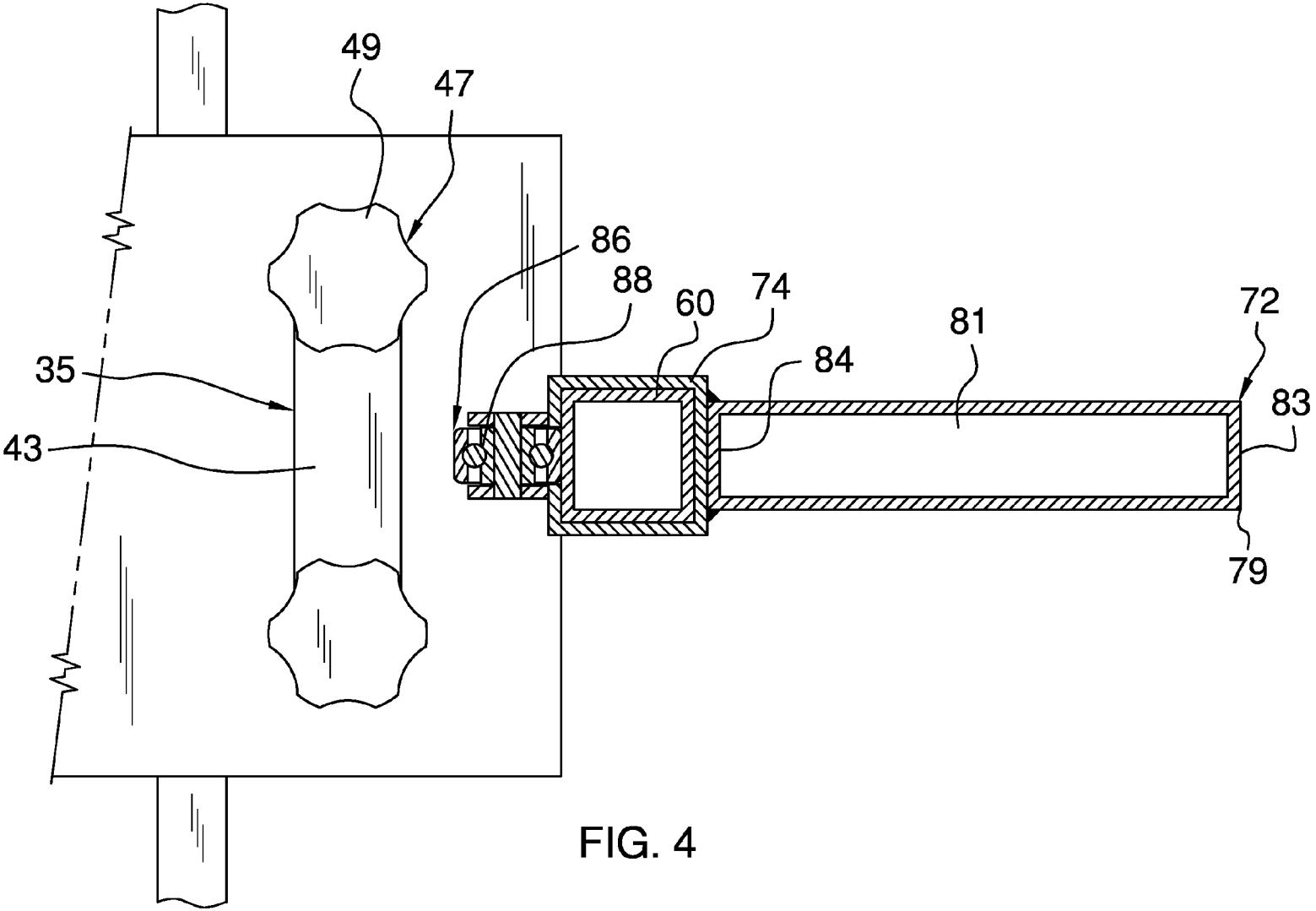
FIG. 4 is a cross-sectional view taken along line 4-4 of FIG. 3.
Figure 5:
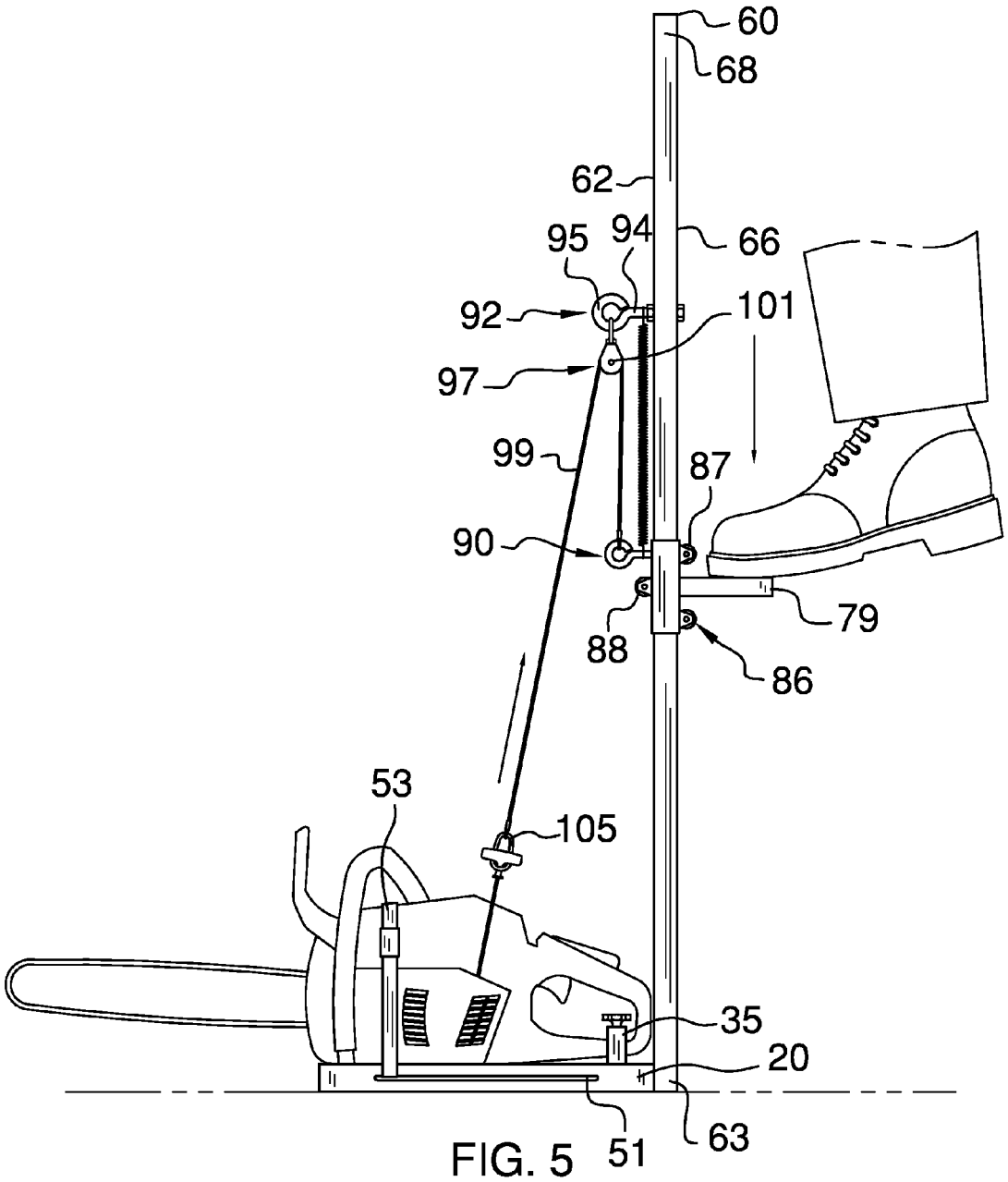
FIG. 5 is an in-use side elevation view.

With reference now to the drawings, and in particular FIGS. 1 through 5 thereof, an example of the instant equipment stabilizer for a pull cord start employing the principles and concepts of the present equipment stabilizer for a pull cord start and generally designated by the reference number 10 will be described.

Referring to FIGS. 1 through 5 the present equipment stabilizer for a pull cord start 10 is illustrated. The equipment stabilizer for a pull cord start 10 includes a base plate 20 having a top side 22, a bottom side 24, a front side 26, a rear side 28, and left side 30, and a right side 32. A jig clamp 35 is disposed on the base plate 20 top side 22 proximal each of the front side 26 and the rear side 28.

Each jig clamp 35 includes an inverted U-shaped brace 37 having a parallelepiped left end 39, a parallelepiped right end 41, a parallelepiped cross-member disposed 43 between the left end 39 and the right end 41, and an opening 45 between the left end 39, the right end 41, the cross-member 43 and the top side 22 of the base plate 20.

A pair of lockable jig bolts 47 is provided. One jig bolt 47 is disposed atop the cross-member 43 on each of the left end 39 and the right end 41. Each jig bolt 47 has a locking knob 49 therein. Each locking knob 49 tightens and alternately loosens to respectively secure and release the respective brace 37 onto and from the base plate 20. A horizontal slot 51 is centrally disposed through the entire base plate 20 from the right side 32 to the left side 30. The slot 51 continuously extends between the jig clamp 35 on the front side 26 to the jig clamp 35 on the rear side 28. A pair of ratchet straps 53 is extendible through the slot 51 proximal each of the front side 26 and the rear side 28.

A hollow square tube upright beam 60 is centrally disposed on the base plate 20 front side 26. The upright beam 60 has a rearward side 62 and a lower side 63 disposed on the front side 26 of the base plate 20, a forward side 66, and an upper side 68. A plurality of vertically aligned apertures 70 is disposed through upright beam 60 proximal the upper side 66.

A foot pedal 72 slidingly engages the upright beam 60. The foot pedal 72 includes a sleeve 74 which slidingly engages the upright beam 60. The sleeve 74 has a front surface 76 and a rear surface 77. The foot pedal 72 includes a pedal member 79 which has an upper surface 81, a lower surface 82, an outer surface 83, and an inner surface 84. The inner surface 84 is disposed on the front surface 76 of the sleeve 74. In addition, the foot pedal 72 includes a plurality of ball bearings 86. A pair of the ball bearings 86 is forward ball bearings 87 disposed on the sleeve 74 front surface 76 in a position proximal the upper surface 81 and the lower surface 82, respectively. One of the ball bearings 86 is a rearward ball bearing 88 centrally disposed on the sleeve 74 rear surface 77.

A first eyebolt 90 is disposed on the rear surface 77 of the sleeve 74 in alignment with the forward ball bearing 87 disposed proximal the upper surface 81. A second eyebolt 92 is selectively disposed in one of the apertures 70 in the upright beam 60 to adjust an amount of tension on a pull start cord of a piece of equipment. Each of the first and second eyebolts 90, 92 has an attachment arm 94 and an eyelet 95. A spring 96 is continuously disposed from the second eyebolt 92 attachment arm 94 to the first eyebolt 90 attachment arm 94.

A pulley 97 is provided to operationally connect the pedal member 79 to the pull cord start. The pulley 97 includes a cable 99, a wheel end 101 mounted to the second eyebolt 92 eyelet 95, a ring 103 attached at a first end 105 of the cable 99 to the first eyebolt 90 eyelet 95, and a carabiner 105 attached to a second end 107 of the cable 99. The carabiner 105 is attachable to a handle of the pull cord start of the piece of equipment. The handle of the pull cord start moves toward the wheel end 101 of the pulley 97 upon the placement of pressure upon the pedal member 79 upper surface 81, such as by pressing on the pedal member 79 with one foot and holding onto the vertical beam while the opposite foot is stationary on a ground surface. Movement of the pull cord start handle toward the wheel end 101 activates a motor of the piece of equipment.

Each ratchet strap 53 has an adjustable length configured to secure and stabilize a body of the piece of equipment to the base plate 20. The base plate 20 has a length and a width configured to accommodate the body of the piece of equipment atop the base plate 20. The jig clamps 35 are configured to secure and stabilize a handle portion and a front portion of the piece of equipment within their respective openings 45.

What is claimed is:

1. An equipment stabilizer for a pull cord start comprising:

a base plate having a top side, a bottom side, a front side, a rear side, and left side, and a right side;

a pair of jig clamps comprising a front jig clamp and a rear jig clamp, wherein each of the front jig clamp and the rear jig clamp is disposed on the base plate top side proximal each of the front side and the rear side, each of the pair of jig clamps comprising:

an inverted U-shaped brace having a parallelepiped left end, a parallelepiped right end, a parallelepiped cross-member disposed between the left end and the right end, and an opening between the left end, the right end, the cross-member and the top side of the base plate;

a pair of lockable jig bolts, one jig bolt disposed atop the cross-member on each of the left end and the right end, each jig bolt having a locking knob therein;

wherein each locking knob tightens and alternately loosens to respectively secure and release the respective brace onto and from the base plate;

a horizontal slot centrally disposed through the entire base plate from the right side to the left side, the slot continuously extending between the front jig clamp and the rear jig clamp;

a pair of ratchet straps extendible through the slot proximal each of the front side and the rear side;

a hollow square tube upright beam centrally disposed on the base plate front side, the upright beam having a rearward side and a lower side disposed on the front side of the base plate, a forward side, and an upper side;

a plurality of vertically aligned apertures disposed through upright beam proximal the upper side;

a foot pedal slidingly engaging the upright beam, the foot pedal comprising:

a sleeve slidingly engaging the upright beam, the sleeve having a front surface and a rear surface;

a pedal member having an upper surface, a lower surface, an outer surface, and an inner surface, the inner surface disposed on the front surface of the sleeve;

a plurality of ball bearings, a pair of the ball bearings being forward ball bearings disposed on the sleeve front surface in a position proximal the upper surface and the lower surface, respectively, and one of the ball bearings being a rearward ball bearing centrally disposed on the sleeve rear surface;

a first eyebolt disposed on the rear surface of the sleeve in alignment with the forward ball bearing disposed proximal the upper surface;

a second eyebolt selectively disposed in one of the apertures in the upright beam, each of the first and second eyebolts having an attachment arm and an eyelet;

a spring continuously disposed from the second eyebolt attachment arm to the first eyebolt attachment arm;

a pulley having a cable, a wheel end mounted to the second eyebolt eyelet, a ring attached at a first end of the cable to the first eyebolt eyelet, and a carabiner attached to a second end of the cable;

wherein the carabiner is attachable to a handle of a pull cord start of a piece of equipment;

wherein the handle of the pull cord start moves toward the wheel end of the pulley upon the placement of pressure upon the pedal member upper surface; and wherein movement of the pull cord start handle toward the wheel end activates a motor of the piece of equipment.

2. The equipment stabilizer for a pull cord start comprising an adjustable length of each ratchet strap being configured to secure and stabilize a body of the piece of equipment to the base plate; and wherein the pair of jig clamps is configured to secure and stabilize a handle portion and a front portion of the piece of equipment with their respective openings.

* * * * *